US009534457B2

(12) United States Patent
Wilson et al.

(10) Patent No.: US 9,534,457 B2
(45) Date of Patent: Jan. 3, 2017

(54) DRILLING APPARATUS WITH DRILL GUIDE

(71) Applicant: J.H. FLETCHER & CO, Huntington, WV (US)

(72) Inventors: Henry E. Wilson, Ironton, OH (US); Sean Casey Farrell, Huntington, WV (US); Robert Sherwood Anderson, Culloden, WV (US); Sean Joseph McQuerrey, South Charleston, WV (US)

(73) Assignee: J.H. FLETCHER & CO, Huntington, WV (US)

( * ) Notice: Subject to any disclaimer, the term of this patent is extended or adjusted under 35 U.S.C. 154(b) by 178 days.

(21) Appl. No.: 14/182,662

(22) Filed: Feb. 18, 2014

(65) Prior Publication Data

US 2014/0231137 A1 Aug. 21, 2014

Related U.S. Application Data

(63) Continuation of application No. PCT/US2012/051305, filed on Aug. 17, 2012.

(60) Provisional application No. 61/524,516, filed on Aug. 17, 2011.

(51) Int. Cl.
*E21B 19/18* (2006.01)
*E21B 19/24* (2006.01)

(52) U.S. Cl.
CPC ..... *E21B 19/24* (2013.01)

(58) Field of Classification Search
CPC ..... E21B 19/00; E21B 19/18; E21B 19/20
See application file for complete search history.

(56) References Cited

U.S. PATENT DOCUMENTS

| | | | | | |
|---|---|---|---|---|---|
| 1,984,621 | A | * | 12/1934 | Babin | E21B 19/161 81/472 |
| 2,828,109 | A | | 3/1958 | Dellner | |
| 2,832,567 | A | | 4/1958 | Fletcher | |
| 3,399,734 | A | | 9/1968 | Folinsbee | |
| 3,749,454 | A | | 7/1973 | Bailey et al. | |
| 4,076,337 | A | | 2/1978 | Childress | |
| 4,190,119 | A | | 2/1980 | Loftis et al. | |
| 4,311,347 | A | * | 1/1982 | Cobb | E21D 20/003 173/188 |
| 4,438,984 | A | | 3/1984 | Leppala | |
| 4,472,002 | A | * | 9/1984 | Beney | E21D 20/003 173/141 |
| 4,703,811 | A | | 11/1987 | Lam | |
| 4,972,911 | A | | 11/1990 | Rajakallio | |
| 5,114,279 | A | * | 5/1992 | Bjerngren | E21D 20/006 405/259.1 |

(Continued)

*Primary Examiner* — William P Neuder
(74) *Attorney, Agent, or Firm* — King & Schickli, PLLC

(57) ABSTRACT

An apparatus for use in connection using a drill having a drilling element for forming a borehole in a face of a mine passage includes a drill guide for engaging the drilling element while permitting the drilling element to move toward the face for forming the borehole. The drill guide includes a keeper for keeping the drilling element in a desired position, which keeper is biased for pivoting movement upon the application of a manual force between an active position for capturing the drilling element and a retracted position for releasing the drilling element. A low profile drill guide is also disclosed, as is a guard for a drill guide, and also related methods.

26 Claims, 8 Drawing Sheets

(56) References Cited

U.S. PATENT DOCUMENTS

| | | | | |
|---|---|---|---|---|
| 6,135,674 | A | 10/2000 | Neilson | |
| 6,302,623 | B1 | 10/2001 | Nellson | |
| 6,736,225 | B2 | 5/2004 | Pierce | |
| 7,381,012 | B2 | 6/2008 | Hinshaw et al. | |
| 7,407,344 | B2 | 8/2008 | Hinshaw et al. | |
| 7,428,935 | B2 | 9/2008 | Hinshaw et al. | |
| 7,428,936 | B2 | 9/2008 | Hinshaw et al. | |
| 7,428,937 | B2 | 9/2008 | Hinshaw et al. | |
| 7,438,141 | B2 | 10/2008 | Hinshaw et al. | |
| 7,600,583 | B2 | 10/2009 | Hinshaw et al. | |
| 7,607,866 | B2 | 10/2009 | Eddowes et al. | |
| 7,617,884 | B2 | 11/2009 | Rubie | |
| 7,704,018 | B2 | 4/2010 | Hinshaw et al. | |
| 2003/0205411 | A1* | 11/2003 | Pierce | E21B 19/24 175/58 |
| 2006/0272862 | A1* | 12/2006 | Hinshaw | E21D 20/006 175/52 |
| 2006/0283634 | A1 | 12/2006 | Hinshaw et al. | |
| 2011/0270255 | A1* | 11/2011 | Smith | A61B 17/1684 606/80 |

* cited by examiner

DRILLING APPARATUS WITH DRILL GUIDE

This application claims the benefit of U.S. Provisional Patent Application Ser. No. 61/524,516, the disclosure of which is incorporated herein by reference.

TECHNICAL FIELD

This disclosure relates to the mining arts and, more particularly, to a drill guide for a drilling apparatus, such as for use in connection with a drill for forming a borehole in a face of a mine passage.

BACKGROUND OF THE INVENTION

Drill guides may be provided for use in connection with guiding a drilling element in the course of forming a borehole in a face of a mine passage. Typically, the drill guide includes a pair of pivotally mounted clamping jaws that close to support the drilling element as the result of the application of hydraulic force. One approach may be found in U.S. Pat. No. 7,428,935 to Hinshaw et al. the disclosure of which is incorporated herein by reference.

The need to provide a manual holding force for the drilling element while these jaws are closed using hydraulic power can require considerable skill, and often leads to suboptimal results. Also, the drill guide hoses for supplying the working fluid to an associated actuator are usually poorly positioned, and prone to failure as a result. Accordingly, a need is identified for an improved drill guide that meets and overcomes one or more of the foregoing limitations and others.

SUMMARY

One aspect of the invention relates to an apparatus for use in connection using a drill having a drilling element for forming a borehole in a face of a mine passage. The apparatus comprises a drill guide for engaging the drilling element while permitting the drilling element to move toward the face for forming the borehole, the drill guide including a keeper for holding the drilling element. The keeper is biased for pivoting movement upon the application of a manual force between an active position for capturing the drilling element and a retracted position for releasing the drilling element.

In one embodiment, the keeper includes a first notch aligning with a second notch of an associated support in the active position of the drill guide. The first and second notches together form a passage in the drill guide for receiving the drilling element.

The apparatus may further include a retainer for retaining the keeper in the active position. The retainer may comprise a hydraulic cylinder having a rod pivotally connected to the keeper. The retainer may also or alternatively comprise a biasing element for urging the keeper toward either the retracted position or active position.

The apparatus may further including a controller for actuating the retainer when a predetermined condition is met. The predetermined condition may be, for example, receiving a feed signal for feeding the drill from an operator input device, receiving a rotation signal for causing the drill to rotate the drilling element from an operator input device, or both. The controller may also deactivate the retainer to allow for manual movement of the drill guide to the retracted position when both the feed signal and the rotation signal are removed.

The apparatus may also include a first stop for engaging the keeper in the active position of the drill guide and a second stop for engaging the keeper in the retracted position of the drill guide.

Another aspect of this disclosure relates to an apparatus for use in connection using a drill having a drilling element for forming a borehole in a face of a mine passage. The apparatus comprises a drill guide for engaging the drilling element while permitting the drilling element to move toward the face for forming the borehole. The drill guide is adapted for pivoting movement between a retracted position for releasing the drilling element from the drill guide and an active position for associating the drilling element with the drill guide. A retainer is provided for retaining the drill guide in at least the active position. A controller is also provided for actuating the retainer on receiving at least one signal corresponding to the movement of the drill relative to the drill guide.

The controller may actuate the retainer on detecting the presence of one of a feed signal or a rotation signal, or both. The controller may deactivate the retainer to allow for manual movement of the drill guide to the retracted position when both the feed signal and the rotation signal are removed.

A further aspect of this disclosure pertains to a drill guide having a first jaw for engaging a drilling element in a first plane and a second jaw for engaging the drilling element in a second, adjacent plane. The first jaw may be mounted for pivoting movement relative to the stationary second jaw.

Still another aspect of this disclosure relates to a drill guide having a support, the support including a notch forming a first jaw for receiving the drilling element and supporting a second jaw pivotally mounted to the support and having a second notch for receiving the drilling element.

Yet a further aspect of the disclosure pertains to an apparatus for use in connection using a drill having a drilling element for forming a borehole in a face of a mine passage in connection with a mast. The apparatus comprises a drill guide for engaging the drilling element while permitting the drilling element to move toward the face for forming the borehole, the drill guide including at least one movable jaw. The apparatus further comprises an elongated shaft extending along the mast and connected at one end to the at least one movable jaw. An actuator is adapted for rotating the elongated shaft for moving the at least one jaw of the drill guide.

In one embodiment, the actuator comprises a cylinder including an extendable rod connected to the elongated shaft. The apparatus may further include a delivery line for delivering a working fluid to or from the cylinder. The delivery line may extend extending along the mast.

Still another aspect of this disclosure pertains to an apparatus for use in connection using a drill having a drilling element for forming a borehole in a face of a mine passage. The apparatus comprises a drill guide having one or more movable jaws for engaging the drilling element while permitting the drilling element to move toward the face for forming the borehole. The drill guide includes a guard having a guide for guiding the drilling element to a position for being engaged by the one or more jaws.

In one embodiment, the guard comprises a pair of spaced plates, and the guide is non-linear. The guide may include an open end and a closed end. The closed end may align with the opening in the drill guide for receiving the drilling element.

Another aspect of this disclosure relates to a method for guiding a drilling element for forming a borehole in a face of a mine passage. The method comprises providing a manually operable drill guide for engaging the drilling element while permitting the drilling element to move toward the face for forming the borehole, the drill guide adapted for pivoting movement to move between a retracted position for releasing the drilling element from the drill guide and an active position for associating the drilling element with the drill guide. The method further comprises preventing the drill guide from moving to the retracted position during the drilling of the borehole.

The method may further include the step of providing a biasing element for biasing the drill guide in at least the active position. Still further, the method may include the step of biasing the drill guide in at least the retracted position, and further including the step of manually moving the drill guide by overcoming the biasing.

A further aspect of this disclosure relates to a method of delivering a drilling element to a drill guide associated with a drill including a chuck for receiving the drilling element upon being inserted therein. The method comprises delivering the drilling element though a guard for guarding the drill guide before inserting the drilling element in the chuck. The delivering step may comprise passing a portion of the drilling element through a labyrinth guide.

BRIEF DESCRIPTION OF THE DRAWING FIGURES

FIGS. 1-4 schematically illustrate a drill mast in various positions for use in forming boreholes in one or more faces of a mine passage;

FIG. 5 schematically illustrates a drill guide in a non-actuated condition;

FIG. 6 schematically illustrates the drill guide of FIG. 5 in an actuated condition;

DETAILED DESCRIPTION

Referring now to FIGS. 1-4, this disclosure relates primarily to a drill guide 10 for use in a drilling or bolting machine, or "bolter." This bolter is used in connection with the installation of support in a face of a mine passage. Specifically, such a bolter is adapted for forming a borehole in the face, and then subsequently installing an anchor (typically an elongated piece of rebar called a "roof bolt") in the borehole. The drill guide 10 typically lends support to and provides guidance for a drilling element, or "drill steel," prior to and during the process of forming the borehole, but must also allow for release when the operation is complete. Although reference will be primarily made herein to a drilling element, it should be appreciated that a drill guide may also lend support for the anchor prior to installation in the borehole.

Figure 4:
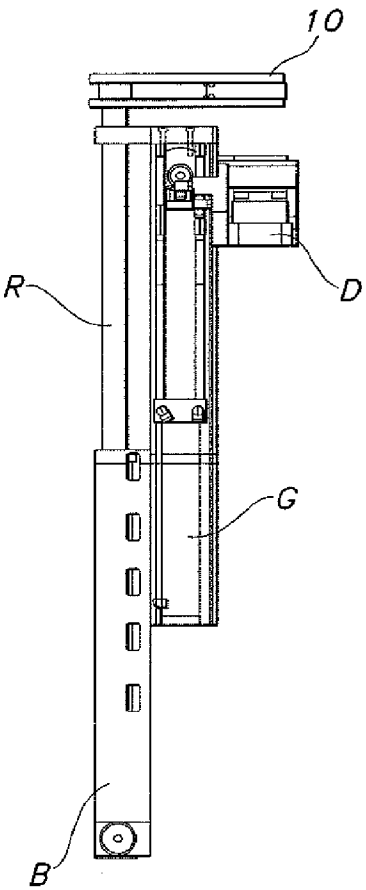
Figure 3:
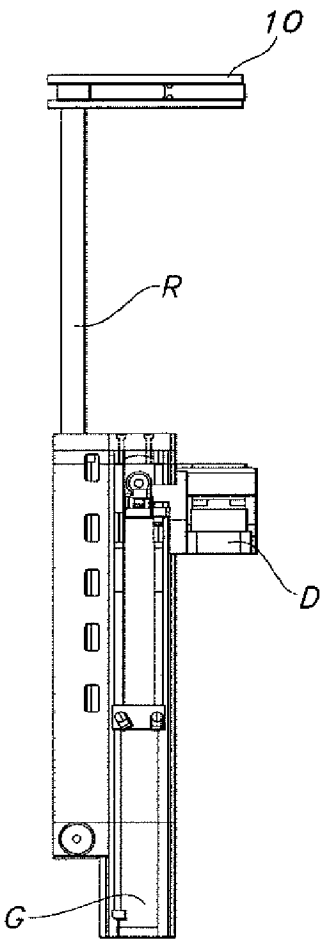
Figure 2:
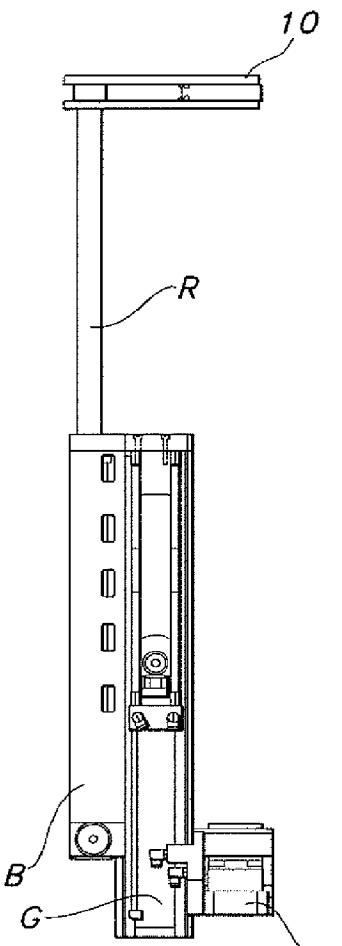
Figure 1:
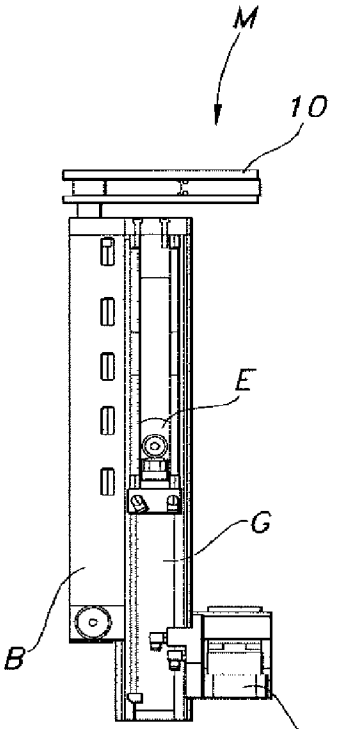

As shown in FIG. 1, the bolter typically includes a mechanism for advancing and retracting a drill D (which includes a chuck for receiving the drilling element) toward any away from the case. This mechanism may comprise a "two-stage" linear mast M having an extendable roof jack J with one or more rods R that are received in a base B. The rods R may support the drill guide 10 at the distal end adjacent the face in use. The drill guide 10 may alternatively or additionally be provided on the base B to lend intermediate support, or elsewhere in the drilling path, without limitation.

The base B supports an elongated bearing member G (such a beam), which in turn carries the drill D during movement toward and away from the mine face (compare FIGS. 2, 3, and 4) in response to the activation of an onboard feed mechanism E, which may comprise a chain drive, linear cylinder, or the like. The bearing member G may also be adapted for moving toward and away from the face (compare FIG. 1 and FIG. 4), and thus may be mounted to the base B so as to permit movement in a linear path in the desired direction.

Figure 5:
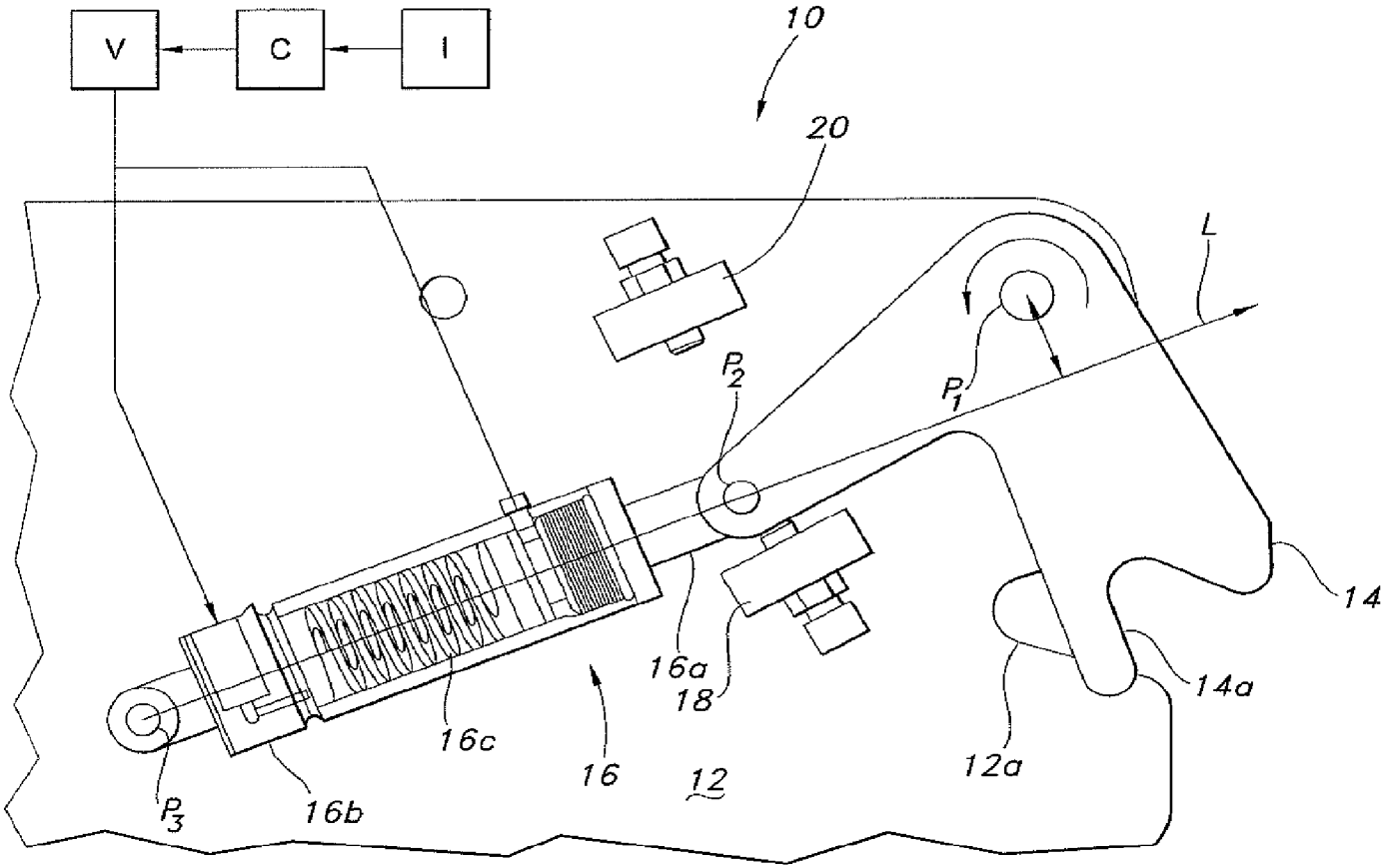
Figure 6:
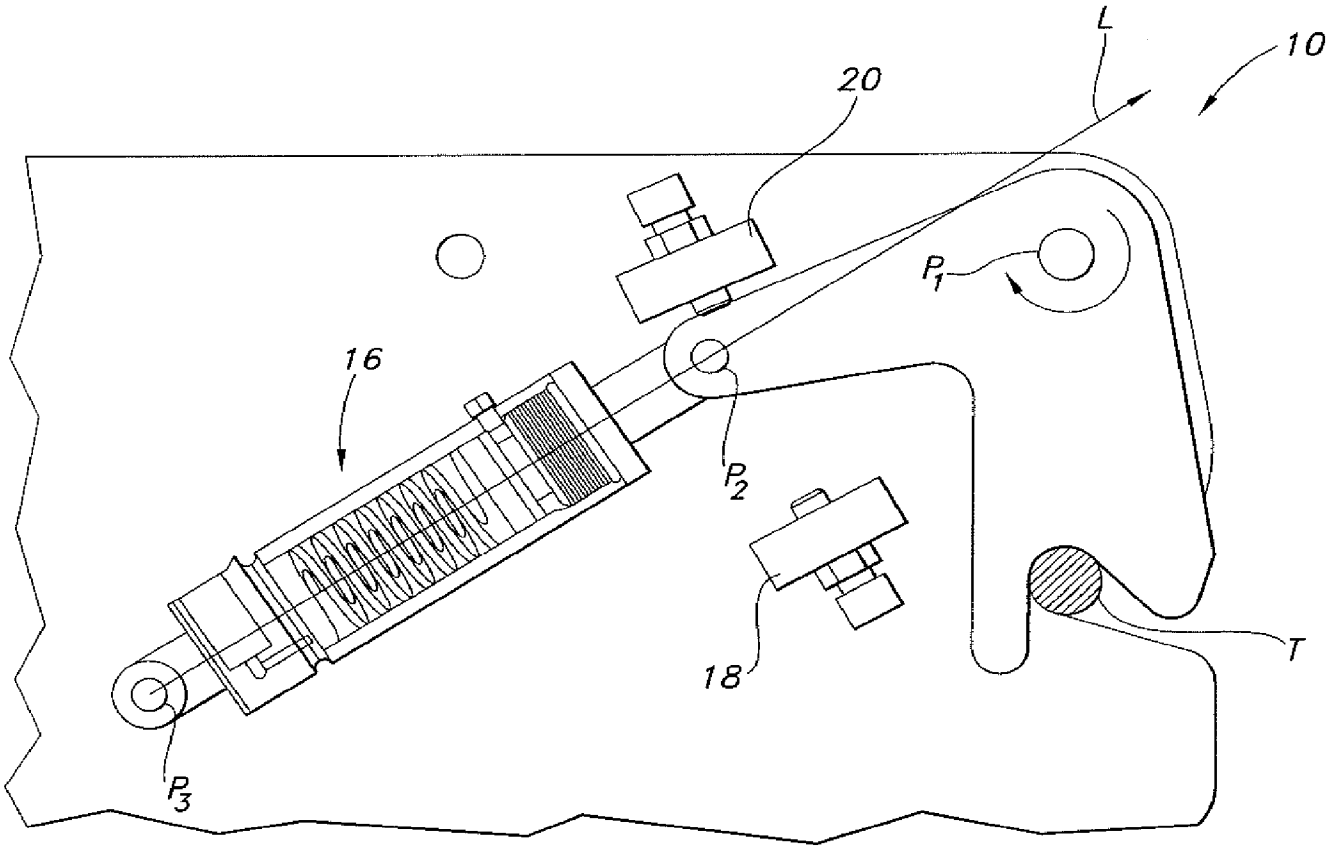

Turning to the plan views of FIGS. 5 and 6, the details of one possible embodiment of a drill guide 10 are shown. The drill guide 10 may comprise a support 12 in the form of a plate having a major surface generally parallel to the plane of the face to be worked. This plate 12 includes a peripheral notch 12*a* arranged for receiving the drilling element. Positioned adjacent to the notch 12*a* is a keeper for keeping the drilling element in the space provided. In one embodiment, this keeper may comprise a holder 14 serving as a first jaw for temporarily holding the drilling element in place before and during the time it is advanced toward and into the face to form the borehole.

In the active position, the holder 14 includes a first end having a notch 14*a* adapted for receiving the drilling element and retaining it within the corresponding notch 12*a* of the plate 12, which may be considered to form a second jaw. As should be appreciated, these jaws lie in different, but adjacent, horizontal planes, thus forming a scissor-like arrangement. The notches 12*a*, 14*a* are shown as being generally V-shaped, but of course could be round, square, or have other shapes while achieving the desired holding function for the drilling element.

As should be appreciated, it is desirable to arrange the drill guide 10 for ready retraction to admit the drilling element, and then activation to hold the drilling element in place. To achieve this, the holder 14 in the illustrated embodiment is mounted for pivoting movement relative to the plate 12 between an open position for allowing notch 14*a*, which is generally U-shaped, to receive the drilling element (FIG. 5) and a closed position (FIG. 6) for confining the drilling element within notch 12*a*. The primary pivot point for the holder 14 is designated as $P_1$.

To provide the movement between these positions, the holder 14 connects with a retainer, which in the illustrated embodiment includes a linear actuator in the form of a hydraulic cylinder 16. This may involve connecting the holder 14 to the rod 16*a* of the cylinder 16 in a manner that allows for relative pivoting movement (designated as $P_2$). The case 16*b* may also be connected to a support, such as plate 12, in a manner that allows for pivoting movement in the same general plane as the holder 14. The pivot point for the cylinder 16 is designated as $P_3$.

Depending on the arrangement, it may be desirable to define the boundaries of relative lateral movement of the holder 14. This may be achieved using stops 18, 20, with the first stop 18 corresponding to the open condition and the second stop 20 corresponding to the closed condition. The stops 18, 20 may comprise extendable, threaded bolts journaled in a support structure, which thus can be adjusted as necessary to provide an engagement surface for the corresponding portion of the holder 14 in the illustrated embodiment. However, it should be appreciated that the stops could also engage the cylinder 16 or other associated structures to achieve a similar result.

The retainer may include a biasing element for urging the holder 14 toward the retracted or active condition, depending on the mode of use. In the illustrated embodiment, the biasing element comprises a coil spring 16*c* contained within the case 16*b* of the cylinder 16 that normally urges the rod 16*a* in a direction along the longitudinal axis L. As will be understood upon reviewing the description that follows, the biasing or spring force along the axis L is selected so that it retains the holder 14 in the active or retracted position, but can be overcome with the application of only manual effort to extend or retract the rod 16*a* when the cylinder 16 is not pressurized. In use, the holder 14 may be considered initially in the open position, as shown in FIG. 5. As should be appreciated, the biasing force aligned with axis L is offset from pivot point $P_1$. Thus, it creates a moment that keeps the holder 14 in the open condition, with stop 18 engaged.

Once associated with the drilling element (shown in cross-section as element T in the plan view FIG. 6), the holder 14 may be rotated toward the closed position, at which point the biasing force aligned with axis L is overcome and the linkage moves past the over center or equilibrium position until engagement with stop 20 is made. The moment about pivot point $P_2$ created by the spring force keeps the holder 14 in the closed condition. In this position, the drilling element is captured in the substantially aligned notches 12*a*, 14*a*, and the drilling operation may proceed.

Once the holder 14 is closed, the keeper or retainer is used to maintain the linkage in the corresponding position. This may be achieved by using a controller for controlling the supply of pressurized fluid from a remote source. In its most basic form, the controller may comprise a valve V (which may include a two position, three way spring return valve). The valve V may be actuated when a corresponding pilot signal is received, which may be activated by a push button or the like.

Alternatively, the pilot signal may automatically issue. For example, the signal may be generated once corresponding signals for feeding and for rotating the drill are provided to a feed and rotation controller C associated with the valve V. The feed and rotation signals may be generated by one or more input devices I (e.g., one or more joysticks, buttons, or the like, positioned at a control panel or elsewhere on an associated mine vehicle, generally away from the location on the face where the borehole is being formed).

This optional requirement for feed and rotation signals before activation of the cylinder 16 helps to assure that the operator is clear of the drill guide 10 after the manual closing operation is completed. Likewise, the pressure may be maintained on the cylinder 16 until both signals for causing feed and rotation of the drill D are removed. This prevents the operator from manually opening the drill guide 10 by moving the holder 14 while either feed or rotation is occurring.

Once feed and rotation signals are removed (usually meaning the borehole is complete and the drill D has been retracted fully from the face), the holder 14 may be manually moved to the open position. The drilling element L may then be withdrawn from the guide 10, such as by removing it from the notch 14*a* of holder 14. If desired, the operation may then be repeated with an anchor element, such as a roof bolt.

Figure 7:
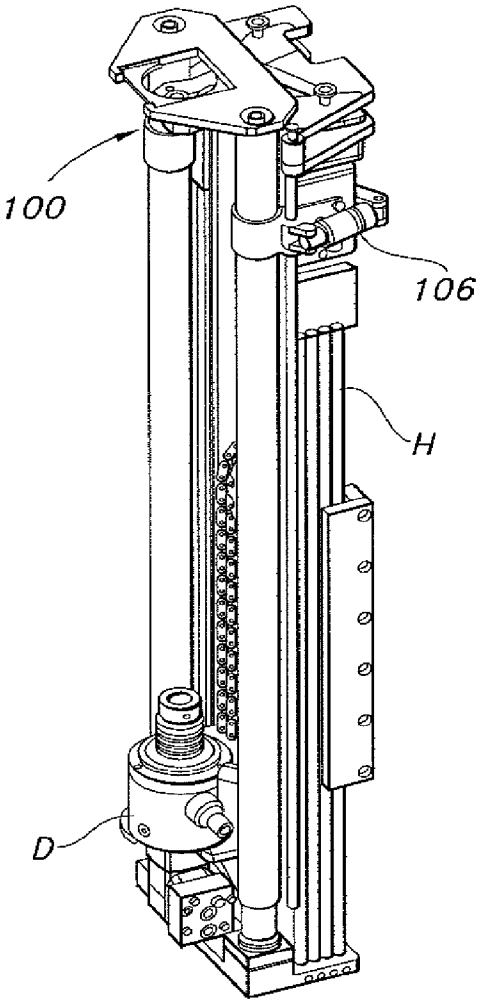
FIG. 7 is a perspective view of a drill mast including a second embodiment of a drill guide.
Figure 8:
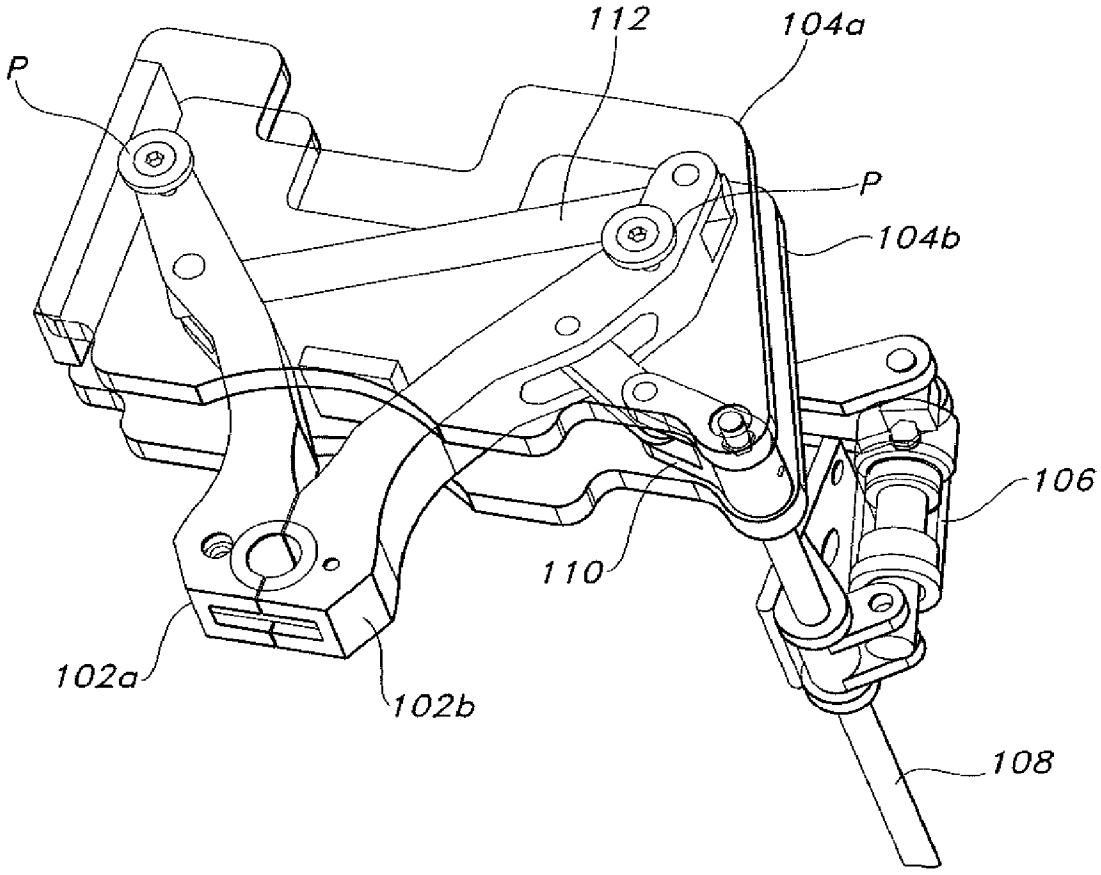
FIG. 8 is a perspective view of the drill guide of FIG. 7 in an actuated condition.
Figure 9:
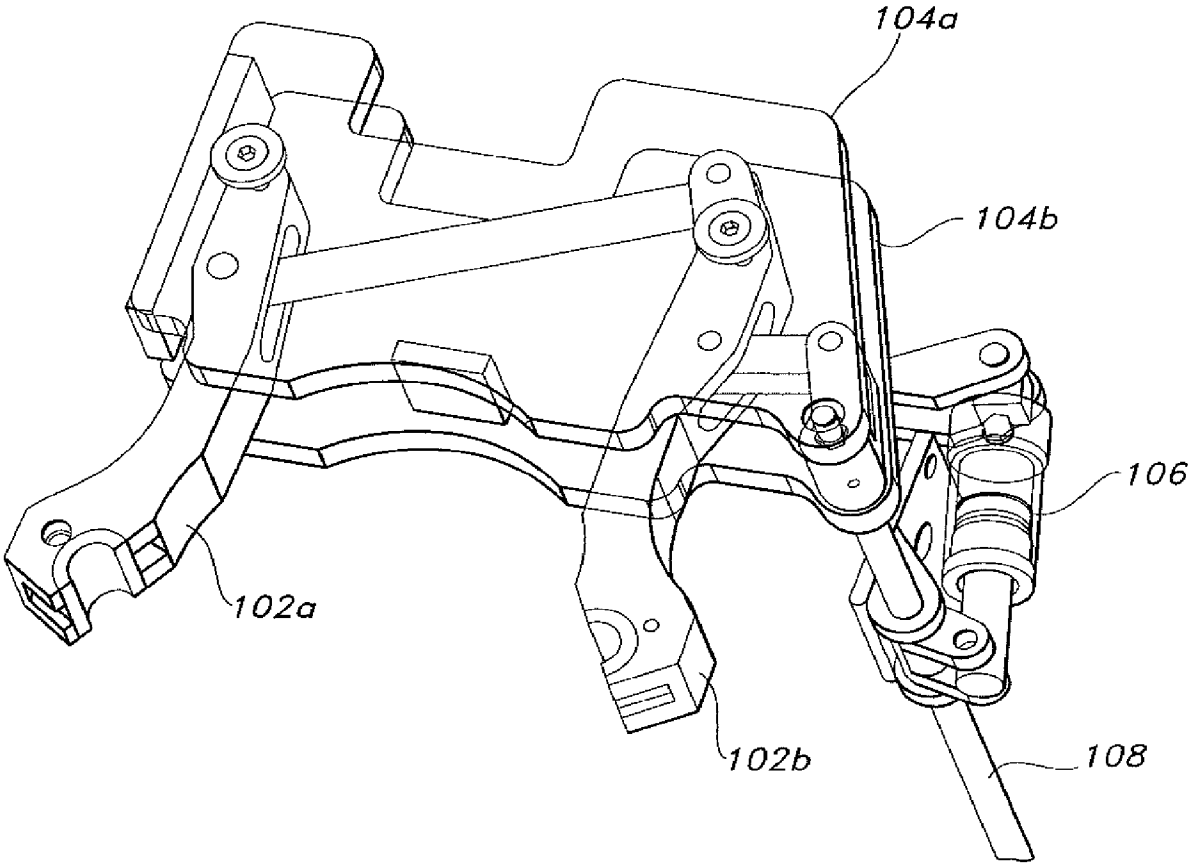
FIG. 9 is a perspective view of the drill guide of FIG. 8 in a non-actuated condition.

Another embodiment of an improved drill guide 100 is shown in FIGS. 7-9. The drill guide of this embodiment includes a pair of jaws 102*a*, 102*b* mounted for movement toward and away from each other in a plane generally transverse to the direction of feed of the drill D. The jaws 102*a*, 102*b* may be sandwiched between a pair of spaced plates 104*a*, 104*b*, and mounted for relative pivoting movement about pivot points P and in a common plane.

An actuator 106 is provided for actuating the jaws 102*a*, 102*b* to move between a first, closed position (FIG. 8) for gripping an object and a second, open position (FIG. 9). The actuator 106 in the illustrated embodiment comprises a linear actuator, such as a hydraulic cylinder, which is provided spaced apart from the jaws 102*a*, 102*b* and plates 104*a*, 104*b*. This advantageously allows for the fluid supply lines to be located away from the drill guide 100, mast, and other moving components. Specifically, in the illustrated embodiment, one or more conduits (e.g., hoses H or telescoping cylinders providing internal fluid delivery and return passages) may be provided along a sidewall of the mast.

To convert the linear movement into rotational movement, the actuator 106 may connect with a rotary member, such as an elongated shaft or rod 108, journaled between or adjacent the drill guide 100, such as through plates 104*a*, 104*b*. A linkage 110 may connect the rod 108 to one of the jaws 102*a*, 102*b*, such as jaw 102*b*, which in turn may be connected by a link 112 to the other jaw, such as jaw 102*a*. In this manner, rotation of the rod 108 causes the jaws 102*a*, 102*b* to open and close, and shown in FIGS. 8 and 9, respectively.

Figure 10:
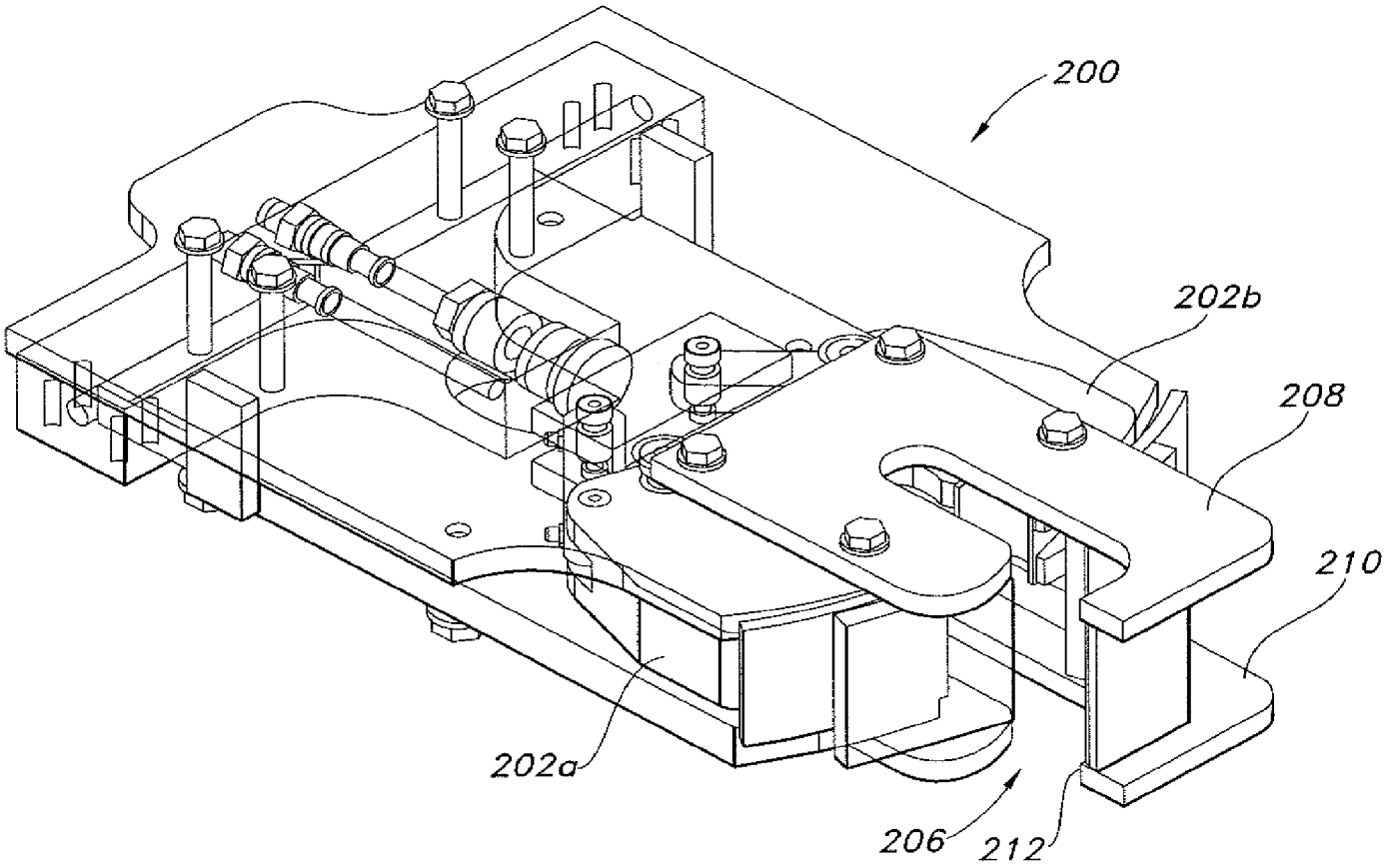
FIG. 10 is a perspective view of a third embodiment of a drill guide including a guard.
Figure 11:
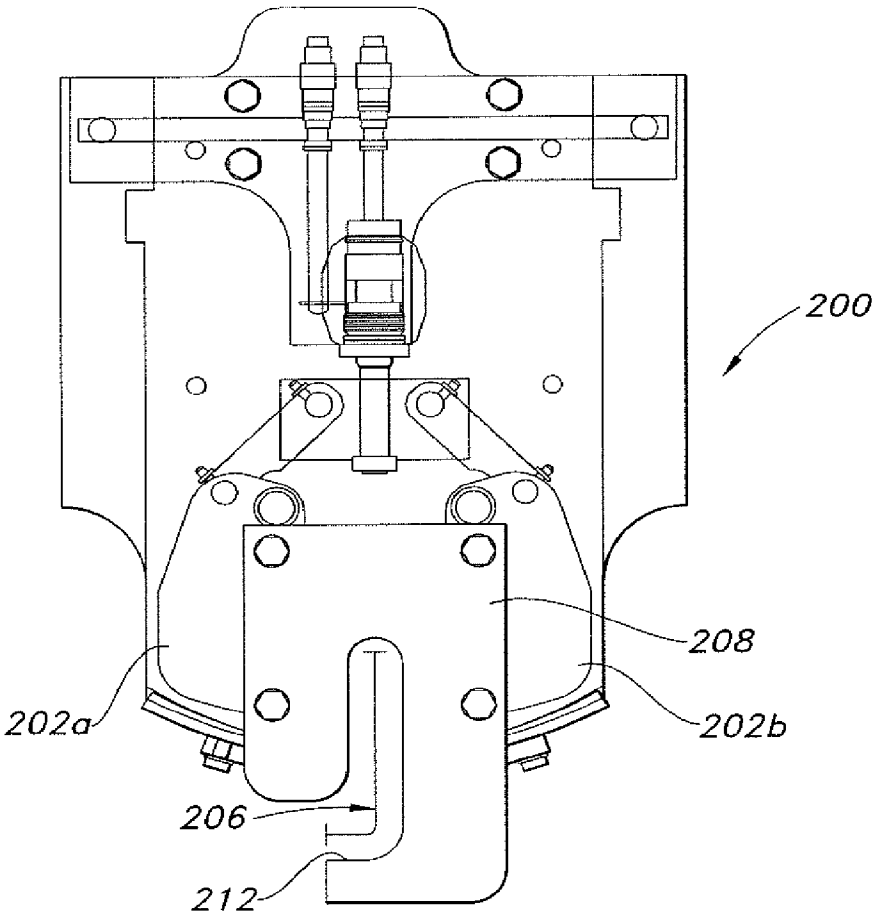
FIG. 11 is a top view of the drill guide of FIG. 10.

In accordance with a further aspect of the disclosure, it is also a desirable option to provide a drill guide 200 including a guard 204 having a guide 206 for guiding the drilling element into the proper position for being gripped, while assisting in preventing the operator's hands from being inadvertently positioned in the path of movement of the gripping jaws 202*a*, 202*b*. In the embodiment illustrated in FIG. 10, the guard 204 comprises at least one, and preferably a pair of spaced, generally parallel plates 208, 210 mounted to and forming an integral part of the guide 200. The plates 208, 210 may be spaced apart a distance slightly greater than the height of the jaws 202*a*, 202*b* in the same (vertical) direction. Each of these plates 208, 210 includes a slot 212 having an open end for receiving the drilling element and a closed end adjacent to the location where the gripping jaws 202*a*, 202*b* close over the drilling element in the operative position. The slots 212 may be non-linear and, specifically, may be generally L-shaped, but could take other forms including for example C-shaped, U-shaped, serpentine, or the like. In any case, the slots 212 are dimensioned so as to only slightly exceed the diameter of the portion of the drilling element adapted to be gripped by the jaws 202*a*, 202*b*.

In use, the operator may manually insert the drilling element into the open end of the labyrinth path of guide 206 and along the slots 212 to the position for being gripped. As should be appreciated, the arrangement is such that the operator's hands may be positioned above or below the plates 208, 210, but generally not in the space between them (in which space the gripping ends of the jaws 202*a*, 202*b* are located). Consequently, the guard 204 helps to prevent contact between the jaws 202*a*, 202*b* and the operator, should inadvertent actuation occur. The path formed by the guard 204 also helps to position the drilling element properly for gripping by the jaws 202*a*, 202*b*, especially when the closed end of guide 206 corresponds to the location where gripping occurs.

The foregoing descriptions of various embodiments are provided for purposes of illustration, and are not intended to be exhaustive or limiting. Modifications or variations are also possible in light of the above teachings. The embodiments described above were chosen to provide the best application to thereby enable one of ordinary skill in the art to utilize the disclosed inventions in various embodiments and with various modifications as are suited to the particular use contemplated. All such modifications and variations (including the combination of any or all of the embodiments disclosed into a single apparatus) are within the scope of the invention.

The invention claimed is:

1. An apparatus for use in connection using a drill having a drilling element for forming a borehole in a face of a mine passage, comprising:

a drill guide for engaging the drilling element while permitting the drilling element to move toward the face for forming the borehole, the drill guide including a keeper for holding the drilling element, the keeper being biased for pivoting movement upon the application of a manual force between an active position for capturing the drilling element and a retracted position for releasing the drilling element.

2. The apparatus of claim 1, wherein the keeper includes a first notch aligning with a second notch of an associated support supporting the keeper in the active position of the drill guide, the first and second notches together forming a passage in the drill guide for receiving the drilling element.

3. The apparatus of claim 1, further including a retainer for retaining the keeper in the active position.

4. The apparatus of claim 3, wherein the retainer comprises a hydraulic cylinder having a rod pivotally connected to the keeper.

5. The apparatus of claim 3, wherein the retainer comprises a spring for urging the keeper toward either the retracted position or active position.

6. The apparatus of claim 3, further including a controller for actuating the retainer when a predetermined condition is met.

7. The apparatus of claim 6, wherein the predetermined condition is selected from the group consisting of: (a) the controller receiving a feed signal for feeding the drill from an operator input device, (b) the controller receiving a rotation signal for causing the drill to rotate the drilling element from an operator input device; and (c) the controller receiving a feed signal for feeding the drill and a rotation signal for causing the drill to rotate the drilling element from one or more operator input devices.

8. The apparatus of claim 6, wherein the controller deactivates the retainer to allow for manual movement of the drill guide to the retracted position when the predetermined condition is no longer met.

9. The apparatus of claim 1, further including a first stop for engaging the keeper in the active position of the drill guide and a second stop for engaging the keeper in the retracted position of the drill guide.

10. The apparatus of claim 1, further including a drill mast including a base for supporting the drill, the mast being extendable for advancing the drill guide toward the face of the mine passage in which the borehole is formed by the drilling element.

11. An apparatus for use in connection using a drill having a drilling element for forming a borehole in a face of a mine passage, comprising:

a drill guide for engaging the drilling element while permitting the drilling element to move toward the face for forming the borehole, the drill guide adapted for pivoting movement between a retracted position for releasing the drilling element from the drill guide and an active position for associating the drilling element with the drill guide;

a retainer for holding the drill guide in at least the active position; and a controller for actuating the retainer on receiving at least one signal corresponding to the movement of the drill relative to the drill guide.

12. The apparatus of claim 11, wherein the controller actuates the retainer on detecting the presence of one or both of a feed signal or a rotation signal.

13. The apparatus of claim 12, wherein the controller deactivates the retainer to allow for manual movement of the drill guide to the retracted position when both the feed signal and the rotation signal are removed.

14. The apparatus of claim 11, further including a drill mast for supporting the drill and advancing the drill guide toward the face of the mine passage in which the borehole is formed by the drilling element.

15. A drill guide having a support, the support including a notch forming a first jaw for engaging the drilling element and supporting a second jaw pivotally mounted to the support and having a second notch for engaging the drilling element, and further including a drill mast comprising a base supporting the drill and extendable rods associated with the base for supporting the first and second jaws.

16. An apparatus for use in connection using a drill having a drilling element for forming a borehole in a face of a mine passage, comprising:

a drill guide for engaging the drilling element while permitting the drilling element to move toward the face for forming the borehole, the drill guide including at least one movable jaw;

a mast for supporting the drill guide;

an elongated shaft supported by the mast and connected at one end to the at least one movable jaw; and an actuator adapted for rotating the elongated shaft for moving the at least one jaw of the drill guide.

17. The apparatus of claim 16, wherein the actuator comprises a cylinder including an extendable rod connected to the elongated shaft.

18. The apparatus of claim 17, further including a delivery line for delivering a working fluid to or from the cylinder, said delivery line and said elongated shaft extending along the mast.

19. The apparatus of claim 16, further including a guard for guarding the drill guide, the guard including a guide for guiding the drilling element to the drill guide.

20. An apparatus for use in connection using a drill having a drilling element for forming a borehole in a face of a mine passage, comprising:

a drill guide having one or more movable jaws for engaging the drilling element while permitting the drilling element to move toward the face for forming the borehole, the drill guide including a guard having a guide for guiding the drilling element to a position for being engaged by the one or more jaws.

21. The apparatus of claim 20, wherein the guard comprises a pair of spaced plates.

22. The apparatus of claim 20, wherein the guide comprises a nonlinear path.

23. The apparatus of claim 20, wherein the guide includes an open end and a closed end.

24. The apparatus of claim 20, further including a drill mast for supporting the drill and the drill guide.

25. An apparatus for use in connection using a drill having a drilling element for forming a borehole in a face of a mine passage, comprising:

a drill guide for engaging the drilling element while permitting the drilling element to move toward the face for forming the borehole, the drill guide including a keeper for holding the drilling element, and means for biasing the keeper such that, upon the application of a manual force, the keeper moves between an active position for capturing the drilling element and a retracted position for releasing the drilling element.

26. The apparatus of claim 25, wherein the biasing means comprises a spring.

* * * * *